US008857823B2

(12) United States Patent
Mårs

(10) Patent No.: US 8,857,823 B2
(45) Date of Patent: Oct. 14, 2014

(54) COUPLING MEANS

(71) Applicant: Marsblade AB, Ostersund (SE)

(72) Inventor: Per Mårs, Ostersund (SE)

(73) Assignee: Marsblade AB, Ostersund (SE)

( * ) Notice: Subject to any disclaimer, the term of this patent is extended or adjusted under 35 U.S.C. 154(b) by 0 days.

(21) Appl. No.: 14/013,608

(22) Filed: Aug. 29, 2013

(65) Prior Publication Data

US 2014/0062041 A1 Mar. 6, 2014

Related U.S. Application Data

(60) Provisional application No. 61/695,384, filed on Aug. 31, 2012.

(51) Int. Cl.

| | |
|---|---|
| ***A63C 1/26*** | (2006.01) |
| ***A63C 1/28*** | (2006.01) |
| ***A63C 1/30*** | (2006.01) |

(52) U.S. Cl.

CPC .. *A63C 1/28* (2013.01); *A63C 1/303* (2013.01)
USPC ..... 280/11.15

(58) Field of Classification Search

USPC ..... 280/11.14–11.16, 11.12, 615, 11.27
See application file for complete search history.

(56) References Cited

U.S. PATENT DOCUMENTS

| | | | | |
|---|---|---|---|---|
| 304,014 | A | 8/1884 | Lincoln | |
| 2,093,915 | A | 9/1937 | Klevstad | |
| 2,725,238 | A | 11/1955 | Day | |
| 3,822,491 | A * | 7/1974 | Rathmell | 36/117.4 |
| 4,396,204 | A | 8/1983 | Smirnykh | |
| 4,602,801 | A | 7/1986 | Vincent | |
| 4,691,931 | A * | 9/1987 | Vincent | 280/11.115 |
| 4,706,974 | A | 11/1987 | Vincent | |
| D304,014 | S | 10/1989 | O'Connell | |
| 5,123,664 | A * | 6/1992 | DeMars | 280/11.18 |

(Continued)

FOREIGN PATENT DOCUMENTS

| | | |
|---|---|---|
| CA | 2314631 A1 | 1/2001 |
| CN | 2093669 U | 1/1992 |

(Continued)

OTHER PUBLICATIONS

Notice of Allowance for co-pending U.S. Appl. No. 13/578,493 dated Mar. 26, 2014.

(Continued)

*Primary Examiner* — John Walters
*Assistant Examiner* — James Triggs
(74) *Attorney, Agent, or Firm* — Harness, Dickey & Pierce, P.L.C.

(57) ABSTRACT

A coupling means arranged in a binding, the binding including an upper chassis section and a lower chassis section which are engaged via the coupling means, and which are pivotally arranged relative to each other in a longitudinal direction, the coupling means comprising a spring back component arranged at either chassis section; and at least one bolt element arranged for engaging, at at least one selected position, with the other chassis section and being arranged on an opposite side of the spring back component in relation to that other chassis section, so that when the chassis sections are pivoted in relation to each other, the spring back component is lifted by the at least one bolt element thereby counteracting the pivoting movement.

14 Claims, 5 Drawing Sheets

(56) References Cited

U.S. PATENT DOCUMENTS

| | | | | |
|---|---|---|---|---|
| 5,125,680 | A | 6/1992 | Bejean et al. | |
| 5,135,244 | A | 8/1992 | Allison | |
| 5,232,231 | A | 8/1993 | Carlsmith | |
| 5,639,104 | A | 6/1997 | Haldemann | |
| 5,755,449 | A | 5/1998 | Pozzobon | |
| 5,890,724 | A | 4/1999 | Gignoux et al. | |
| 5,927,728 | A | 7/1999 | Gignoux et al. | |
| 5,979,916 | A | 11/1999 | Gatel et al. | |
| 6,007,075 | A * | 12/1999 | Shum | 280/11.12 |
| 6,113,111 | A * | 9/2000 | Gierveld et al. | 280/11.15 |
| 6,152,458 | A | 11/2000 | Edauw et al. | |
| 6,227,550 | B1 | 5/2001 | Maggiolo | |
| 6,523,835 | B1 | 2/2003 | Lyden | |
| 6,561,525 | B1 | 5/2003 | Chou | |
| 6,736,412 | B1 * | 5/2004 | Krah | 280/11.224 |
| 6,843,497 | B1 * | 1/2005 | Riepler | 280/615 |
| 6,971,652 | B2 | 12/2005 | Bobbert et al. | |
| 7,270,343 | B2 * | 9/2007 | Riepler | 280/615 |
| 7,419,187 | B2 | 9/2008 | Haugen et al. | |
| 2003/0116941 | A1 | 6/2003 | Mash | |
| 2005/0051996 | A1 | 3/2005 | Riepler | |
| 2005/0206109 | A1 | 9/2005 | Mash | |
| 2012/0133104 | A1 * | 5/2012 | Mars | 280/11.221 |
| 2013/0344774 | A1 * | 12/2013 | Allen | 451/28 |

FOREIGN PATENT DOCUMENTS

| | | | |
|---|---|---|---|
| CN | 1094982 | A | 11/1994 |
| DE | 78733 | | 1/1894 |
| DE | 29614090 | U1 | 1/1997 |
| DE | 29814854 | U1 | 1/1999 |
| EP | 0230989 | | 8/1987 |
| EP | 0786275 | | 7/1997 |
| EP | 0795348 | | 9/1997 |
| EP | 0903168 | A1 | 3/1999 |
| EP | 1319424 | | 6/2003 |
| FR | 2758093 | | 7/1998 |
| FR | 2816516 | A1 | 5/2002 |
| NL | 8702068 | | 4/1989 |
| WO | WO 00/09223 | | 2/2000 |
| WO | WO-2007137834 | A1 | 12/2007 |
| WO | WO 2010/124382 | | 11/2010 |

OTHER PUBLICATIONS

Office Action for co-pending U.S. Appl. No. 13/578,493 dated Nov. 27, 2013.

Office Action for co-pending U.S. Appl. No. 13/384,457 dated Dec. 11, 2013.

International Search Report for international patent application No. PCT/SE2012/000036 dated Jun. 12, 2012.

Written Opinion of the International Searching Authority for international patent application No. PCT/SE2012/000036 dated Jun. 12, 2012.

International Search Report for international patent application No. PCT/SE2011/000016 dated May 18, 2011.

Notive of Allowance for co-pending U.S. Appl. No. 13/578,493 dated Mar. 26, 2014.

Office Action for co-pending U.S. Appl. No. 13/384,457 dated Apr. 10, 2014.

Chinese Office Action for Chinese Application No. 201180008556.X dated May 9, 2014.

* cited by examiner

COUPLING MEANS

Marsblade owns Swedish patents Publ. No 535465 (U.S. patent application Ser. No. 13/578,493) and 534628 (U.S. patent application Ser. No. 13/384,457).

BACKGROUND OF THE INVENTION

The above referenced patents refer to a technology for inline skates, ice skates and ski bindings. The technology improves the ability for ice skaters, inline skaters and skiers to shift the center of gravity along the length of the foot, from heel to toe, with an even pressure, thereby improving skating/skiing comfort and performance.

The technology includes a chassis comprising at least one upper chassis section and at least one lower chassis section. The chassis sections include at least one first contact surface and at least one second contact surface, wherein at least one of the contact surfaces is curved or partially curved. The contact surfaces are arranged so that the chassis sections can pivot in relation to each other in the longitudinal direction, and so that at least a portion of a curved contact surface is in contact with at least a portion of another contact surface. The upper chassis section and the lower chassis section are interconnected by a coupling means that has both a coupling and a spring back effect. The type of coupling means is non exhaustive in the patent applications, and can be of any kind as long as it has the two mentioned characteristics. The present application is for a specific type of such coupling means.

DETAILED DESCRIPTION OF THE INVENTION

Figure 1A:
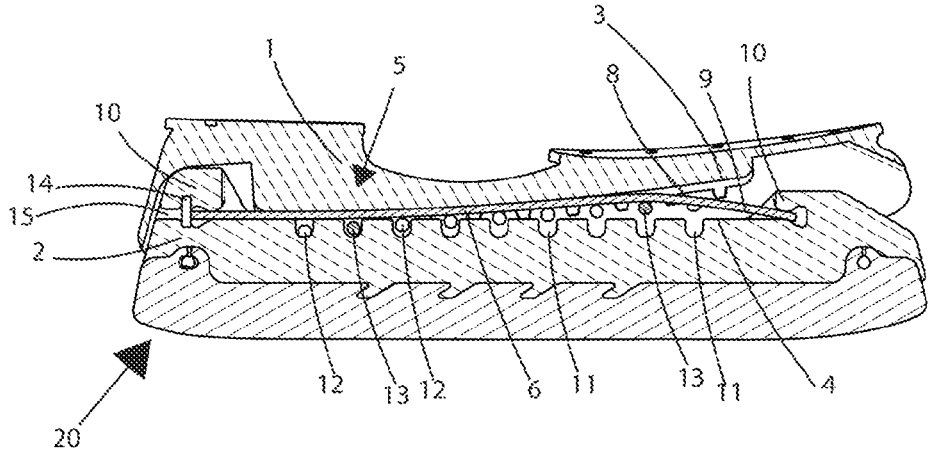
FIGS. 1 *a-d* are cross sectional side views of a chassis schematically illustrating an embodiment of the coupling means according to the invention, and FIG. 1 *e* shows a perspective side view of a chassis schematically illustrating an embodiment of the coupling means.
Figure 1B:
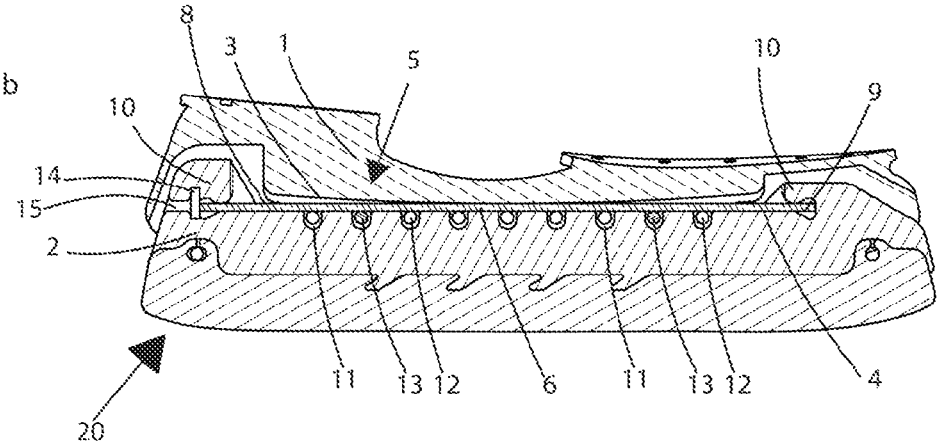
Figure 1C:
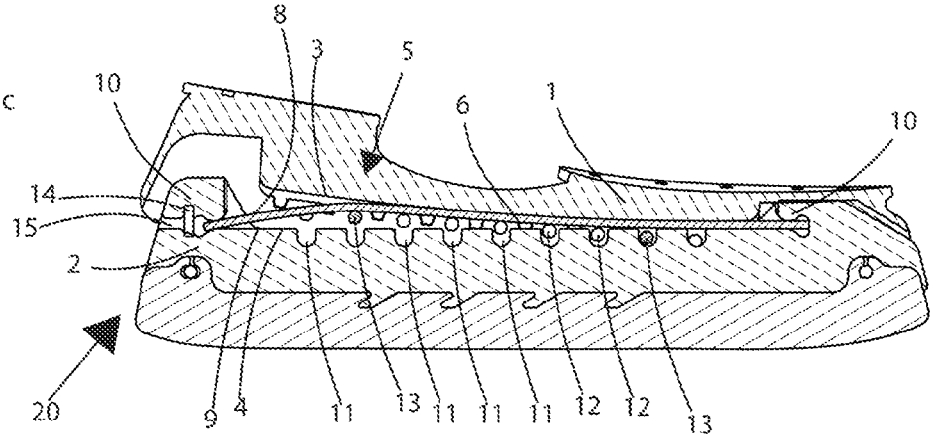
Figure 1D:
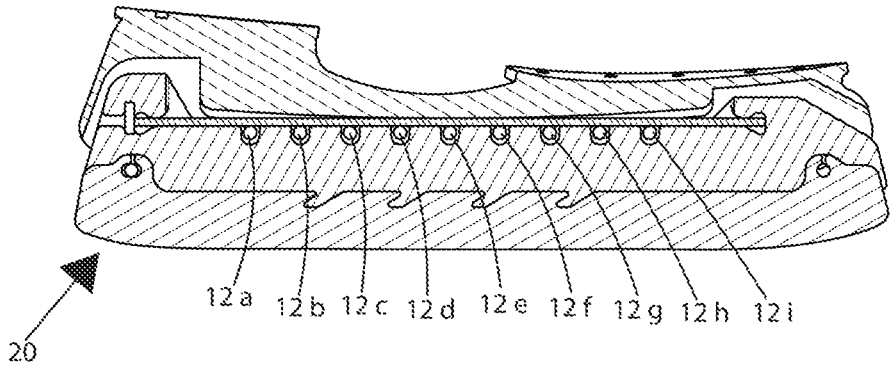
Figure 1E:
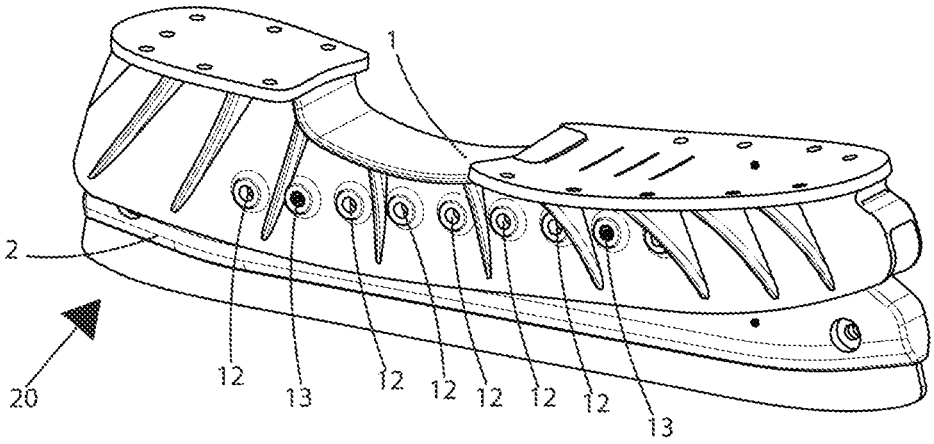

FIG. 1 *a-c* are cross sectional side views of a chassis schematically illustrating an embodiment of the coupling means 5, and its function. FIG. 1 *a* shows the upper chassis 1 rocking (being tilted) backward with respect to the lower chassis 2. FIG. 1 *b* shows the upper chassis 1 and the lower chassis 2 in their neutral position. FIG. 1 *c* shows the upper chassis 1 rocking forward with respect to the lower chassis 2. In this embodiment the coupling means 5 is arranged in a chassis 20 designed for ice-skating. In other embodiments, the chassis 20 and the coupling means 5 can be designed for inline (roller) skating or for ski bindings. The chassis 20 comprises at least an upper chassis section 1 that is connected to at least a lower chassis section 2 through a coupling means 5 in accordance with the present invention. The upper chassis section 1 includes at least a first contact surface 3 and the lower chassis section 2 includes at least a second contact surface 4. The first contact surface 3 and the second contact surface 4 are arranged so that they are facing each other. In this embodiment the first contact surface 3 is curved and the second contact surface 4 is flat. The coupling means 5 includes at least one spring back component 6, e.g. a leaf spring, running in the chassis 20 longitudinal direction. In this embodiment the spring back component 6 is arranged between the first contact surface 3 and the second contact surface 4. In this embodiment the spring back component 6 includes a third contact surface 8 and a fourth contact surface 9. At least a portion of the third contact surface 8 bear against the first contact surface 3 and at least a portion of the fourth contact surface 9 bear against the second contact surface 4. The spring back component 6 can be made of any suitable material such as e.g. metal, plastic, rubber, composite or wood, or some combination of such materials. The spring back component 6 is held in place in relation to the lower chassis section 2 at its front and back end by suitable holding means 10. In the exemplifying embodiment the holding means 10 are formed by recesses arranged in a front end and a back end protuberance of the lower chassis section 2, respectively.

The lower chassis 2 further includes a number of grooves 11 along its contact surface 4. In the exemplifying embodiment the grooves 11 are arranged at predefined positions along the lower chassis section 2 (forming a position indicator, or a gauge scale). Further, each groove 11 is arranged extending perpendicularly with respect to the lower chassis section's 2 longitudinal direction.

Figure 2:
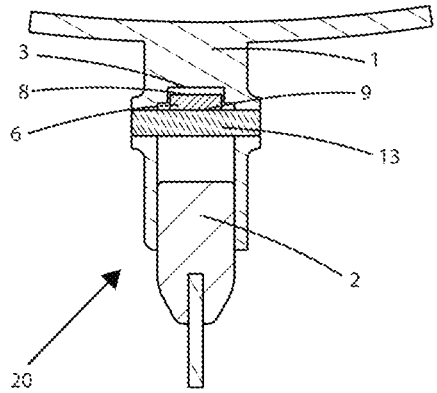
FIG. 2 is a cross sectional front view of a chassis comprising an embodiment of the coupling means according to the invention.

To continue, the upper chassis section 1 includes a number of perpendicular holes 12. Each hole 12 is arranged at a position corresponding to the position of a respective groove 11 of the lower chassis section 2. The coupling means 5 includes at least one sprint/axis 13, which is arranged extending through at least one of the holes 12. This is further illustrated in FIG. 2, which is a cross sectional front view of the chassis 20. The sprint/axis 13 is further arranged below the spring back component 6. The embodiment of FIG. 1*a-c* comprises two sprints/axes 13 arranged in a respective hole 12. In this embodiment the sprint/axis 13 extends through at least the width of the upper chassis 1. In alternative embodiments the sprint/axis 13 may just partly be extended through the upper chassis section 1.

The purpose of each groove 11 is to make room for a sprint/axis 13 to vertically move freely in relation to the lower chassis 2 as the upper chassis section and the lower chassis section are rocked with respect to each other.

The coupling means' 5 coupling effect is enabled through the sprint/axis 13 running through the holes 12 in the upper chassis 1, through the grooves 11 in the lower chassis 2, and under the spring back component 6, that is held in place to the lower chassis section 3 by the holding means 10.

The coupling means' 5 spring back effect is enabled as a curved contact surface rocks/rolls against another contact surface, as the sprint/axis 13, which is attached to the holes 12 in the upper chassis section, lifts the spring back component 6 from a portion of the second contact surface 4, thereby bending it in relation to its neutral shape (initial shape), under accumulation of energy. The spring back component's 6 spring back effect is achieved as it strives to return to its neutral position, releasing the accumulated energy. In the exemplifying embodiment the spring back components 6 neutral shape is straight. In alternative embodiments the spring back components 6 neutral shape can be curved.

In FIG. 1 *d* the different hole positions 12 *a-i* (the number of holes can in embodiments of the invention be selected to be higher or lower than shown here) of the exemplifying embodiment are shown in more detail. In this figure the sprints/axes 13 are not shown. The hardness of the spring back functionality can be adjusted by placing the sprints/axis'

13 in the different positions in the longitudinal direction of the chassis, i.e. in different holes 12 (*a-i*), see FIG. 1 *d*. By placing the sprints/axis' 13 in holes 12 that are placed more towards the front end and/or back end of the chassis 20 in the longitudinal direction e.g. holes 12 *a, b, h* and *i*, the spring back hardness is greater than when placing the sprints/axis' 13 in holes 12 that are placed more towards (closer to) the center of the chassis 20 in the longitudinal direction e.g. holes 12 *c, d, e, f* and *g*.

The hardness of the spring back functionality can also be adjusted in other ways like for example switching hardness, thickness, material or design of the spring back component 6.

During mounting of the chassis 20, the spring back component 6 is, in the exemplified embodiment, mounted in the lower chassis section 2 by first being pushed in through a hollow (an opening) 15 arranged in an end section of the lower chassis section 2. Subsequently, the spring back component 6 is locked in position by a stopper (a locking element) 14. The stopper 14 can be any suitable design, component and/or material. The upper chassis segment 1 is then placed on top of the lower chassis segment 2 with the spring back components 6 fourth contact surface 9 facing the lower chassis segment's 2 second contact surface 4. The upper chassis segment 1 and the lower chassis segment 2 are then mounted together to form a functioning chassis 20 by fixating the sprints/axis' 13 in a respective hole 12.

The current coupling means 5 allows for a sturdier combination of a spring back and coupling functionality with a simplified adjustability compared to previously known coupling elements.

FIG. 1 *e* shows a perspective side view of the chassis 20 where the holes 12 and sprints 13 can be seen from the outside.

Figure 3:
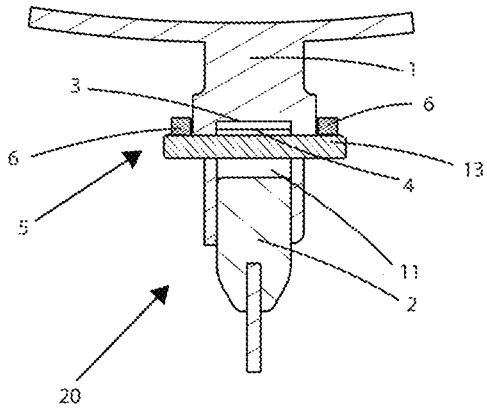
FIG. 3 is a cross sectional front view of an embodiment of the coupling means according to the present invention, and FIGS. 4-7 each show a cross sectional side view of a chassis schematically illustrating respective embodiments of the coupling means according to the invention.

FIG. 3 shows a cross sectional front view of an alternative embodiment of the present invention where there are two spring back components 6 arranged separate from the first contact surface 3 and the second contact surface 4. In alternative embodiments there can be one, or more than two spring back components arranged separate from the first contact surface 3 and the second contact surface 4.

Figure 4:
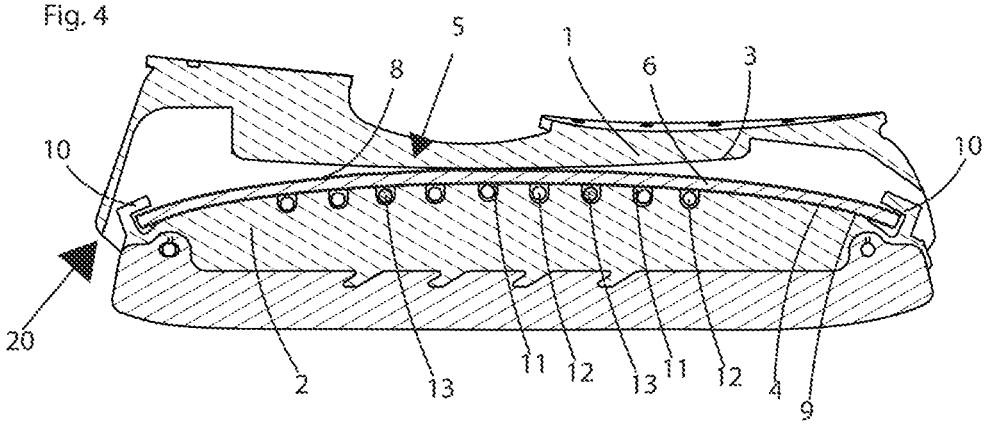

FIG. 4 shows an alternative embodiment that has a similar configuration as the embodiment described with reference to FIG. 1. Here the first contact surface 3 is curved, the second contact surface 4 is curved and the spring back component 6 is curved in its neutral position.

Figure 5:
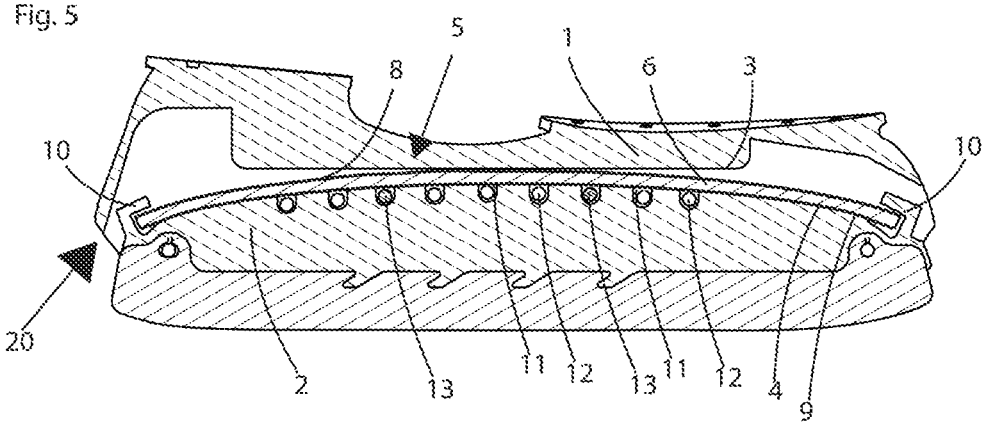

FIG. 5 shows an alternative embodiment that has a similar configuration as the embodiment described with reference to FIG. 1. Here the first contact surface 3 is flat, the second contact surface 4 is curved and the spring back component 6 is curved in its neutral position.

Figure 6:
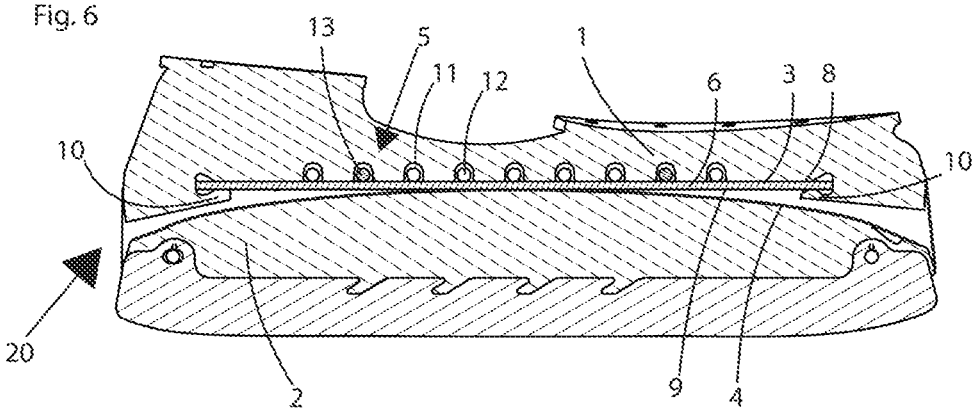

FIG. 6 shows an alternative embodiment that has a similar configuration as the embodiment described with reference to FIG. 1. Here the first contact surface 3 is flat, the second contact surface 4 is curved and the spring back component 6 is flat in its neutral position. Note that the coupling means 5 is here provided in an inverted form, where the spring back component 6 is fixated in the upper chassis section 1. Further, recesses 11 are provided in the contact surface 3 of the upper chassis section, and corresponding holes 12 are arranged in the lower chassis section 2 to provide positions for the sprint/axis 13 which is inserted in a respective hole 12 while the spring back component is positioned below the sprint/axis 13.

Figure 7:
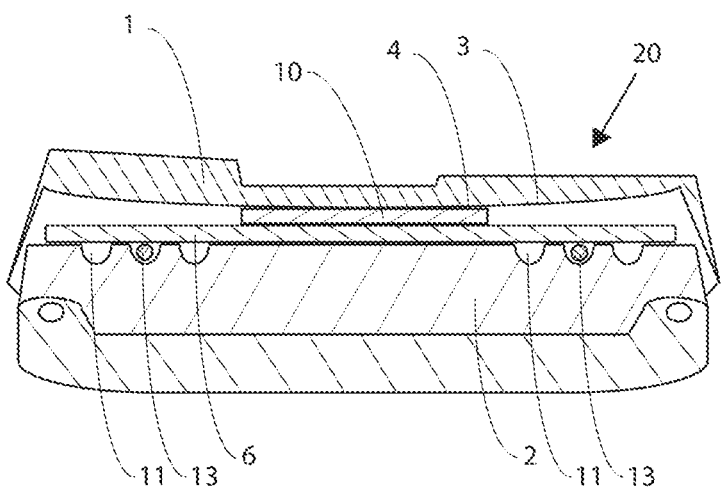

FIG. 7 is a cross sectional side view schematically illustrating a chassis 20 with a similar configuration as the embodiments described above with reference to the previous figs. An embodiment of a coupling means according to the invention is illustrated in which the spring back component 6 of the coupling means is arranged between the upper chassis 1 and the lower chassis 2. The upper chassis 1 forms a curved first contact surface 3 arranged facing a second contact surface 4 of the lower chassis section 2, and is pivotably arranged with respect to the lower chassis 2. As previously described, the upper chassis section 1 is connected to the lower chassis section 2 through a coupling means in accordance with the present invention. The coupling means comprises a spring back component 6, e.g. a leaf spring, running in the chassis 20 longitudinal direction. The spring back component 6 is held in place in relation to the lower chassis section 2, at a center portion thereof, by suitable holding means. The holding means is here a protruding portion 10 provided with an opening in which the spring back component 6 is inserted, such that the spring back component 6 is kept in place relative to the lower chassis section 2. The protruding element 10 may be integrated with the lower chassis section 2 or provided by an externally attached protruding element. In this embodiment, the second contact surface 4 of the lower chassis section 2 is flat and arranged on an upper side of the protruding element 10. In a similar manner as previously described in more detail with reference to e.g. the embodiment shown in FIGS. 1 *a-c*, and FIG. 2, the upper chassis section 1 includes a number of perpendicular holes (not indicated in FIG. 7) arranged to receive at least one sprint/axis 13 (i.e. a bolt element) preferably extending through the width of the upper chassis and being arranged below the spring back element 6 (see FIG. 2), such that the at least one sprint 13 is engaged with the upper chassis element 1 while providing lifting of the spring back element 6 as the upper chassis element 1 is pivoted in relation to the lower chassis element 2. In FIG. 7, two sprints 13 are mounted at a respective selected position at opposite sides of the center portion of the chassis 20, which positions are selected from a total of six possible positions governed by holes in the upper chassis element. Corresponding grooves 11 arranged in the lower chassis section 2 receives the sprints 13 as the upper chassis section 1 is pivoted such that the first contact surface 3 is pushed into contact with a contact surface formed on the upper surface of the spring back component 6.

The coupling means 5 can be embodied in different ways but always has both a coupling and a spring back functionality. This is achieved either through one or several elements, each of which, individually or in combination, has either one or both effects. The elements can be placed together or separately. Non-exhaustive examples of elements include axles, screws, bolts, springs, straps and bushings. Regardless of embodiment, the parts that enable these effects are comprised in the "coupling means". The embodiments shown in the drawings are only possible embodiments of this type of coupling means and are not limiting for the scope of the present invention.

The invention claimed is:

1. A coupling means arranged in a binding, the binding including an upper chassis section and a lower chassis section which are engaged via the coupling means, and which are pivotally arranged relative to each other in a longitudinal direction, the coupling means comprising:

a spring back component arranged at either chassis section; and at least one bolt element arranged for engaging, at at least one selected position, with the other chassis section and being arranged on an opposite side of the spring back component in relation to that other chassis section, so that when the chassis sections are pivoted in relation to each other, the spring back component is lifted by the at least one bolt element thereby counteracting the pivoting movement.

2. The coupling means in accordance with claim 1, wherein said spring back component is arranged extending along a longitudinal direction of the upper chassis section and the lower chassis section.

3. The coupling means in accordance with any preceding claim, wherein the spring back component is integrated in the upper chassis section or the lower chassis section.

4. The coupling means in accordance with any preceding claim, wherein at least one end portion of the spring back component is connected to said either chassis section.

5. The coupling means in accordance with any preceding claim, wherein at least a center portion of the spring back component is connected to said either chassis section.

6. The coupling means in accordance with any preceding claim, wherein the spring back component comprises at least one of metal, rubber, composite, plastic, and wood.

7. The coupling means according to any preceding claim, wherein the binding further includes a first contact surface and a second contact surface, wherein at least one of the first contact surface and the second contact surface is curved, wherein the first contact surface and the second contact surface are arranged such that, during pivoting of said upper chassis section and said lower chassis section relative to each other, at least a portion of said first contact surface is in contact with at least a portion of said second contact surface.

8. The coupling means in accordance with claim 7, wherein said spring back component is arranged between said first contact surface and said second contact surface.

9. The coupling means in accordance with claim 7, wherein said spring back component is arranged separate from said first contact surface and said second contact surface.

10. The coupling means in accordance with any preceding claim, further comprising holding means arranged for fixating said spring back component in relation to said upper chassis section or said lower chassis section.

11. The coupling means in accordance with claim 10, wherein said holding means are arranged at a front end protuberance and a back end protuberance of either chassis section.

12. The coupling means in accordance with any preceding claim, wherein the spring back component comprises at least one leaf spring.

13. The coupling means in accordance with claim 12, wherein a neutral shape of said leaf spring is curved.

14. The coupling means according to any preceding claim, wherein said at least one selected position is governed by at least one corresponding receiving opening arranged in said other chassis section.

* * * * *